United States Patent [19]

Kirschner et al.

[11] Patent Number: 4,955,507

[45] Date of Patent: Sep. 11, 1990

[54] ORANGE JUICE DISPENSING SYSTEM

[75] Inventors: Jonathan Kirschner; Kenneth G. Smazik, both of Marietta; Gary V. Paisley, Lilburn, all of Ga.

[73] Assignee: The Coca-Cola Company, Atlanta, Ga.

[21] Appl. No.: 408,813

[22] Filed: Sep. 18, 1989

Related U.S. Application Data

[63] Continuation-in-part of Ser. No. 924,379, Oct. 29, 1980, abandoned.

[51] Int. Cl.[5] ..... B67D 5/56

[52] U.S. Cl. ..... 222/65; 137/100; 222/57; 222/59; 222/71; 222/129.4

[58] Field of Search ..... 222/52, 57, 59, 63, 222/71, 129.1–129.4, 133–135, 145; 137/98,100

[56] References Cited

U.S. PATENT DOCUMENTS

| | | | |
|---|---|---|---|
| 2,440,365 | 4/1948 | Copping et al. | 225/26 |
| 2,547,423 | 4/1951 | Wegman et al. | 255/21 |
| 2,724,581 | 11/1955 | Pahl et al. | 259/18 |
| 3,056,559 | 10/1962 | Orr | 239/306 |
| 3,229,077 | 1/1966 | Gross | 364/510 |
| 3,263,932 | 8/1966 | Ruland | 239/304 |
| 3,323,681 | 6/1967 | Divette et al. | 222/129.1 |
| 3,642,171 | 2/1972 | Ernst | 222/57 X |
| 3,688,947 | 9/1972 | Reichenberger | 222/129.3 X |
| 3,900,043 | 8/1975 | Bowen et al. | 137/101.21 |
| 3,935,971 | 2/1976 | Papoff et al. | 222/134 |
| 4,053,901 | 10/1977 | Skafvenstedt et al. | 417/435 X |
| 4,141,467 | 2/1979 | Augustijn et al. | 222/133 X |
| 4,194,650 | 3/1980 | Nottke et al. | 222/133 X |
| 4,341,327 | 7/1982 | Zeitz | 222/63 |
| 4,478,357 | 10/1984 | Jenkins | 222/135 |
| 4,487,333 | 12/1984 | Pounder et al. | 222/54 |

FOREIGN PATENT DOCUMENTS

| | | | |
|---|---|---|---|
| 0176318 | 4/1986 | European Pat. Off. . | |
| 1909012 | 11/1970 | Fed. Rep. of Germany . | |
| 58-45514 | 3/1983 | Japan | 222/23 |
| 970220 | 9/1964 | United Kingdom . | |
| 2020631 | 11/1979 | United Kingdom . | |
| 2033333 | 5/1980 | United Kingdom . | |
| 2146620 | 4/1985 | United Kingdom . | |

OTHER PUBLICATIONS

Waukesha Foundry Division, *Waukesha Pump Engineering Manual,* pp. 21, 50–51 (1976).

*Primary Examiner*—Kevin P. Shaver
*Attorney, Agent, or Firm*—Thomas R. Boston; W. Dexter Brooks

[57] ABSTRACT

An orange juice dispensing system including a pump driven by a d.c. motor for pumping concentrate through a concentrate conduit to a mixing chamber of a dispensing valve, a water line for feeding water to the mixing chamber and including a flow meter and a motorized control valve therein, sensors connected to the pump for sensing concentrate flow rate, and a microcontroller receiving signals from the pump sensors and the water flow meter for controlling the mixture ratio and flow rate by controlling the motorized control valve in the water line and the d.c. motor connected to the concentrate pump. The concentrate is preferably contained in a nonreturnable, plastic, semi-rigid container.

7 Claims, 1 Drawing Sheet

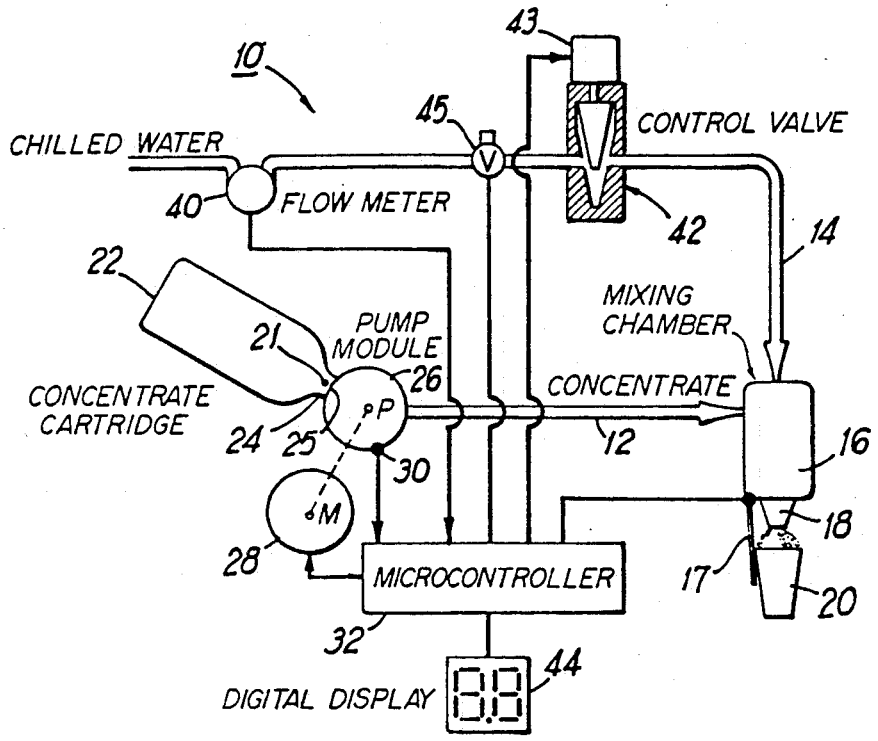
10
43
45
CONTROL VALVE
CHILLED WATER
40
FLOW METER
42
14
22
MIXING
CHAMBER
21
PUMP
MODULE
26
CONCENTRATE
CONCENTRATE
CARTRIDGE
24
25
12
16
30
M
18
28
MICROCONTROLLER
17
20
32
44
DIGITAL DISPLAY

ORANGE JUICE DISPENSING SYSTEM

CROSS-REFERENCE TO RELATED APPLICATION

This is a continuation-in-part of U.S. patent application Ser. No. 06/924,379, filed Oct. 29, 1980 by the same inventors and having the same title and assignee as this application, and now abandoned.

BACKGROUND OF THE INVENTION

1. Field of the Invention

This invention relates to a system for reconstituting and dispensing juice, and in a preferred embodiment thereof to an orange juice dispensing system that controls the mixture ratio and flow rate.

2. Description of the Prior Art

Post-mix orange juice dispensing systems are known; however, such known systems do not provide a satisfactorily controlled mixture ratio. For example, it is known to use constant pressure on a concentrate reservoir to provide a constant flow rate. However, the desired result is not achieved because orange juice concentrate viscosity changes with the season, and with the types of oranges picked, and also because pressure regulators vary slightly which also varies the flow rate. It is also known to use a peristaltic pump for the concentrate, however, it has been found that such pumps are limited in the distance that they will pull concentrate because of the viscosity of the concentrate. It is also known to use gravity feed of concentrate from a reservoir located above the dispensing valve, and to use an automatic flow control refill system for the reservoir. However, such systems occupy a large area of counter space, which is often not acceptable.

It is an object of the present invention to provide a system for reconstituting and dispensing juice that solves the problems in the prior art mentioned above.

It is another object of the present invention to provide a juice dispensing system using a peristaltic pump for the concentrate with sensors for detecting flow rate therethrough, a flow meter in the water line, and a microcontroller preprogrammed for controlling one or both of the concentrate or water flow to maintain the desired, predetermined mixture ratio.

It is another object of the present invention to provide such a juice dispensing system using a d.c. motor controlling the pump, a motorized control valve in the water line, and a microcontroller to control mixture ratio and individual and total flow rate.

It is another object of the present invention to provide a juice dispensing system in which the juice is contained in a rigid, non-returnable plastic container that is connected to the pump to provide a gravity head and that is vented to atmosphere.

SUMMARY OF THE INVENTION

A system for reconstituting and dispensing juice, and in a preferred embodiment thereof orange juice, including a container for the juice concentrate, a pump (preferably a peristaltic pump) to which the juice container is connected to provide a gravity head for the peristaltic pump, a motor (preferably a d.c. motor) for driving the pump, means for sensing the flow rate through the pump, a flow meter in the water line for measuring the water flow rate, a motorized control valve in the water line and a microcontroller receiving the signals from the pump's sensor and the flow meter for controlling the mixture ratio and the individual and total flow rate by controlling the speed of the d.c. motor and/or by controlling the motorized control valve. The container is preferably a plastic, semi-rigid, nonreturnable bottle such as the well known PET soft drink bottles. However, a reusable container can also be used.

BRIEF DESCRIPTION OF THE DRAWING

Tbe present inventino will be more fully understood from the detailed description below when read in connection with the accompanying drawing wherein:

The FIGURE is a partly diagrammatic, partly schematic illustration of a system for reconstituting and dispensing orange juice in accordance with the present invention.

DETAILED DESCRIPTION OF THE PREFERRED EMBODIMENTS

The present invention will now be described in detail with reference to the attached drawing wherein the FIGURE shows a dispensing system 10 wherein juice concentrate and water are fed through a concentrate conduit 12 and a water line 14, respectively, to a mixing chamber 16 of a nozzle 18 for dispensing the resulting beverage into a cup 20.

The juice concentrate is preferably delivered to a restaurant in a semi-rigid, non-returnable plastic container 22 having a spout, fitting, opening or neck 24. The neck 24 connects to an inlet port 25 of a peristaltic pump 26. The container 22 is vented to atmosphere (such as by an opening 21 in the neck 24 large enough to admit air but not large enough to allow liquid to flow therethrough) and is oriented (inverted) to provide a gravity head for the peristaltic pump 26. A motor 28, preferably a d.c. motor, is connected to and drives the peristaltic pump 26. One or more sensors 30 detect the movement of the pump's rollers (not shown). The period between the sensing of the rollers is proportional to the concentrate flow rate. The sensors 30 are connected to a microcontroller 32 which includes control electronics for sensing the period of the peristaltic pump 26 and thus the concentrate flow rate.

A flow meter 40 is connected in the water line 14 for measuring the water flow rate. Pulses from the flow meter are proportional to the water flow rate. The flow meter is also connected to the microcontroller 32 which contains control electronics for sensing the flow meter pulses and thus the water flow rate.

The peristaltic pump 26 is driven by a d.c. motor 28 and the microcontroller 32 can vary the speed of the peristaltic pump's d.c. motor. The control of the peristaltic pump can thus provide the desired volumetric flow rate of concentrate to maintain the desired mixture ratio.

In a preferred embodiment, the water line also contains a motorized control valve 42, operated for example, by a d.c. stepping motor 43. The microcontroller 32 can control the mixture ratio and the total flow rate by controlling both the d.c. motor 28 and the motorized control valve 42. In addition, the water line 14 includes a solenoid controlled on-off valve 45 controlled by the microcontroller 32. The on-off valve 45 is opened when a lever arm 17 is actuated and the valve 45 is closed when the juice dispensing is completed.

A well-known microcontroller that can be used is an Intel 8096. The Intel 8096 is a single chip computer designed specifically for controlling applications. This microcontroller has designated pins for digital input. The flow meter and concentrate pump sensors 30 are connected to digital input pins. The microcontroller also has designated digital and analog output pins. The pump motor and control valve are each connected to an analog output pin. The water valve is connected to a digital output pin.

The microcontroller is preprogrammed for proper machine operation. In a typical dispensing sequence an operator presses a cup 20 against the cup lever 17. The cup lever is connected to a switch. The microcontroller senses the switch closing and starts the pump motor 28, opens the water on/off valve 45 and positions the control valve 43. The flow meter 40 produces electrical pulses when water flows. The microcontroller compares the pulse rate to a preprogrammed pulse rate. If the pulse rates differ, the microcontroller adjusts the control valve 43. The concentrate pump sensors 30 also produce electrical pulses when the pump turns. The microcontroller compares the pump sensors pulse rate to a preprogrammed pulse rate. If the pulse rates differ, the microcontroller adjusts the pump motor 28 speed. This preprogramming is a straight forward task for any software engineer. The program is loaded into the memory of the Intel 8096. The Intel 8096 has a built in ROM (read only memory) for this purpose.

This invention will thus achieve a predetermined mixture ratio for the beverage dispensed into the cup 20. It can do so by varying either one or both of the flow rates of the water and the concentrate. It can also vary the total flow rate of the mixture into the cup, while at the same time ensuring that whatever the total flow rate is, the ratio of the water to the concentrate will be the predetermined ratio.

Regarding how the microcontroller decides which flow rate needs to be controlled, i.e., the water, the concentrate, or both, the answer is that it decides based on how it is programmed to operate. The microprocessor can be programmed to operate in any one of a large number of alternative ways (and different programmers would, in fact, prepare different programs) even for the same application of this invention, and the present invention can be used in many different situations, and each one could use a different program. For example, one may prefer to adjust only the water flow rate, but then, under certain conditions it would then be desirable to start to adjust the concentrate flow rate. All of these variables depend on the details of the particular application. The particular details of any particular program for the microprocessor are no more essential to this invention than are the particular details of the pump. It is not essential to this invention as to when it is the water or when it is the concentrate that is being controlled at any given time; what is important is that there be the control means and that it control the mixture ratio.

The actual reconstituting of the metered water and concentrate is done in the mixing chamber 16 therein. The resulting beverage is then dispensed through the nozzle 18 into a cup 20. The reconstituting can use either a static or a dynamic mixer.

It is also preferred to provide a digital display 44 connected to the microcontroller 32 which continuously displays the mixture ratio being controlled by the microcontroller 32 so that an operator can tell at a glance if the dispensing system 10 is operating properly. If the display changes from a desired ratio to an unacceptable ratio (for example, when the container 22 becomes empty), the operator can manually turn off the system 10, or alternatively the microcontroller can include means for automatically terminating further flow of water and concentrate.

In an alternative embodiment, the system 10 can include the motorized control valve 42, but no d.c. motor 28 (some other motor means can be used to drive the pump 26). The mixture ratio is then controlled by controlling just the motorized control valve 42.

While the preferred embodiment of this invention has been described in detail, it is to be understood that variations and modifications can be made therein without departing from the spirit and scope of the present invention as set forth in the appended claims. For example, while a particular concentrate container is described, others can be used. For example, a rigid bottle can be used or a flexible bag-in-box can be used with suitable coupling means, and for a rigid bottle, with suitable vent means. Other means can be used for the flow meter, control valve, gravity head and pump port than the particular ones shown.

We claim:

1. Apparatus for reconstituting and dispensing juice comprising:

(a) a pump having a variable speed drive motor connected thereto and having an inlet port for receiving juice concentrate;

(b) a mixing chamber for mixing water and concentrate and for dispensing the mixture therefrom as a beverage;

(c) a concentrate conduit extending from said pump directly to said mixing chamber with no control valve or flow meter therein;

(d) a water line connected to said mixing chamber and a motorized, variable flow, control valve in said water line;

(e) first means for sensing the water flow rate and second means for sensing the speed of the pump and thus the concentrate flow rate; and (f) a microcontroller for controlling the mixture ratio of the beverage dispensed from said mixing chamber, said microcontroller being connected to said first and second sensing means for receiving signals therefrom, to said motor for controlling the speed thereof and therefore the concentrate flow rate through said pump, and to said motorized, variable flow control valve in said water line for controlling the water flow therethrough.

2. The apparatus as recited in claim 1 wherein said second sensing means comprises sensors in said pump for detecting the concentrate flow rate therethrough, and wherein said motor is a d.c. motor.

3. The apparatus as recited in claim 1 wherein said first sensing means comprises a flow meter in said water line for measuring the water flow rate and wherein said microcontroller is connected to said flow meter and receives signals therefrom.

4. The apparatus as recited in claim 3 wherein said second sensing means includes sensors in said pump for detecting the concentrate flow rate therethrough, wherein said motor is a d.c. motor and wherein said microcontroller includes means for maintaining said desired ratio by controlling both said d.c. motor and said motorized control valve.

5. The apparatus as recited in claim 4 wherein said microcontroller also includes means for controlling the total flow rate to said mixing chamber.

6. The apparatus as recited in claim 4 including a semi-rigid, nonreturnable concentrate container connected to said pump, and means for venting said container to atmosphere.

7. The apparatus as recited in claim 6 wherein said container is connected to said pump in an inverted position.

* * * * *